United States Patent [19]

Kulczycki

[11] 3,999,578

[45] Dec. 28, 1976

[54] TRIAXIAL WEAVING MACHINE WITH HEDDLE SHIFTING MEANS AND METHOD

[75] Inventor: Karol Kulczycki, Parsippany, N.J.

[73] Assignee: Barber-Colman Company, Rockford, Ill.

[22] Filed: Aug. 11, 1975

[21] Appl. No.: 603,657

[52] U.S. Cl. ..... 139/11; 139/DIG. 1

[51] Int. Cl.[2] ..... D03D 41/00; D03C 13/00

[58] Field of Search ..... 139/1, DIG. 1, 11, 35, 139/48, 49, 50, 46; 66/66, 69, 85

[56] References Cited

UNITED STATES PATENTS

| | | | |
|---|---|---|---|
| 1,752,804 | 4/1930 | Nicolet | 139/11 |
| 3,140,592 | 7/1964 | Clark | 66/85 |
| 3,799,209 | 3/1974 | Dow | 139/11 |

FOREIGN PATENTS OR APPLICATIONS

| | | | |
|---|---|---|---|
| 484,092 | 1/1952 | Italy | 139/11 |

*Primary Examiner*—Henry S. Jaudon
*Attorney, Agent, or Firm*—Bell, Seltzer, Park & Gibson

[57] ABSTRACT

A triaxial fabric weaving machine and method in which a plurality of elongate heddles for guiding warp yarns are arranged in weftwise rows amd are moved longitudinally in passageways for forming the warp strands into warp sheds through which wefts are inserted. During weaving, heddles are shifted weftwise of the rows and from one passageway to another to thereby move the warp strands from one weftwise location to another.

22 Claims, 6 Drawing Figures

TRIAXIAL WEAVING MACHINE WITH HEDDLE SHIFTING MEANS AND METHOD

This invention relates to triaxial fabric weaving machines in which warp strands are guided by heddles and arranged in weftwise rows and which are provided with means for shifting heddles weftwise and thereby displacing warp strands from one weftwise position to another.

More particularly, this invention relates to triaxial fabric weaving machines having elongate heddles movable longitudinally for forming warp strands guided thereby into warp sheds which receive wefts. While triaxial weaving machines of this general type have been proposed heretofore, such proposals have suffered deficiencies with respect to guiding heddles in longitudinal movement while maintaining the heddles in predetermined spaced relation and with respect to shifting heddles weftwise.

With the foregoing in mind, it is an object of the present invention to provide passageways for guiding heddles during longitudinal movement thereof to form warp strands guided thereby into warp sheds. In realizing this object of the present invention, the difficulties and deficiencies of prior proposed triaxial fabric weaving machines are overcome in that the weaving machine of this invention accomplishes weftwise shifting of warp strands for movement thereof from one position to another while guiding the longitudinal movement of heddles as warp sheds are formed.

A further object of this invention is the weaving of triaxial fabrics in accordance with a method in which a plurality of warp strands are engaged by heddles and are formed into warp sheds as the heddles are guidingly moved longitudinally in passageways. During weaving, the heddles and warp strands engaged thereby are shifted weftwise to move the heddles from one passageway to another and to move the warp strands from one weftwise location to another.

A further object of this invention is the accomplishment of positive weftwise movement of heddles along weftwise rows, so as to control the weftwise positioning of warp yarns. In realizing this object of the present invention, passageways which receive and guide heddles are defined by cooperating fixed separators and movable separators, with the movable separators moving relative to the fixed separators during weaving and thereby shifting heddles from one passageway to an adjacent passageway.

Some of the objects of the invention having been stated, other objects will appear as the description proceeds, when taken in connection with the accompanying drawings, in which FIG. 1 is a schematic top plan view of a triaxial weaving machine in accordance with this invention;

Figure 2:
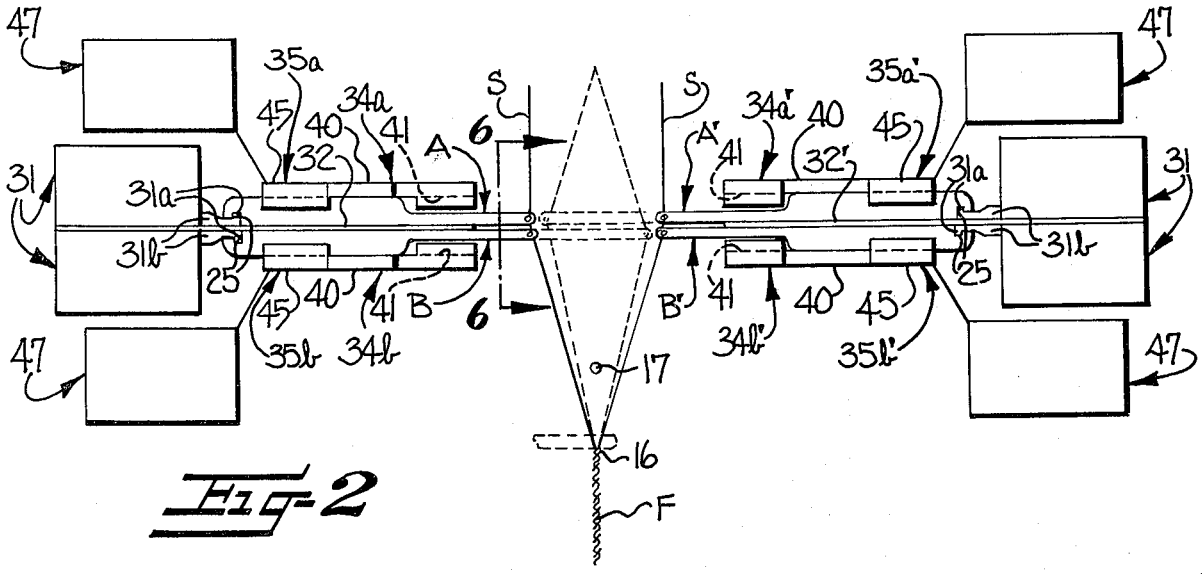
FIG. 2 is a fragmentary end elevation view of the weaving machine of FIG. 1.

Referring more specifically to the drawings, a weaving machine embodying the present invention has a plurality of elongate heddles arranged in weftwise rows for guiding, and forming warp sheds of, respective warp strands S (FIG. 2). The weaving machine may include any desired number of weftwise rows of heddles, just so long as at least one such row of heddles is provided on each side of the machine. By way of illustration, four weftwise rows of heddles A, A′, B, B′ are shown in FIG. 2. The upper rows A, A′ constitute a first set or pair of substantially opposing weftwise rows of heddles, and the lower rows B, B′ constitute a second set or pair of substantially opposing weftwise rows of heddles, with the two sets of heddles A, A′, B, B′ being disposed warpwise of each other. More specifically, it will be observed in FIG. 2 that the lower pair of substantially opposing weftwise rows of heddles B, B′ are disposed closely adjacent to and in the direction of the fell or downstream of the other pair of weftwise rows of heddles A, A′.

Figure 1:
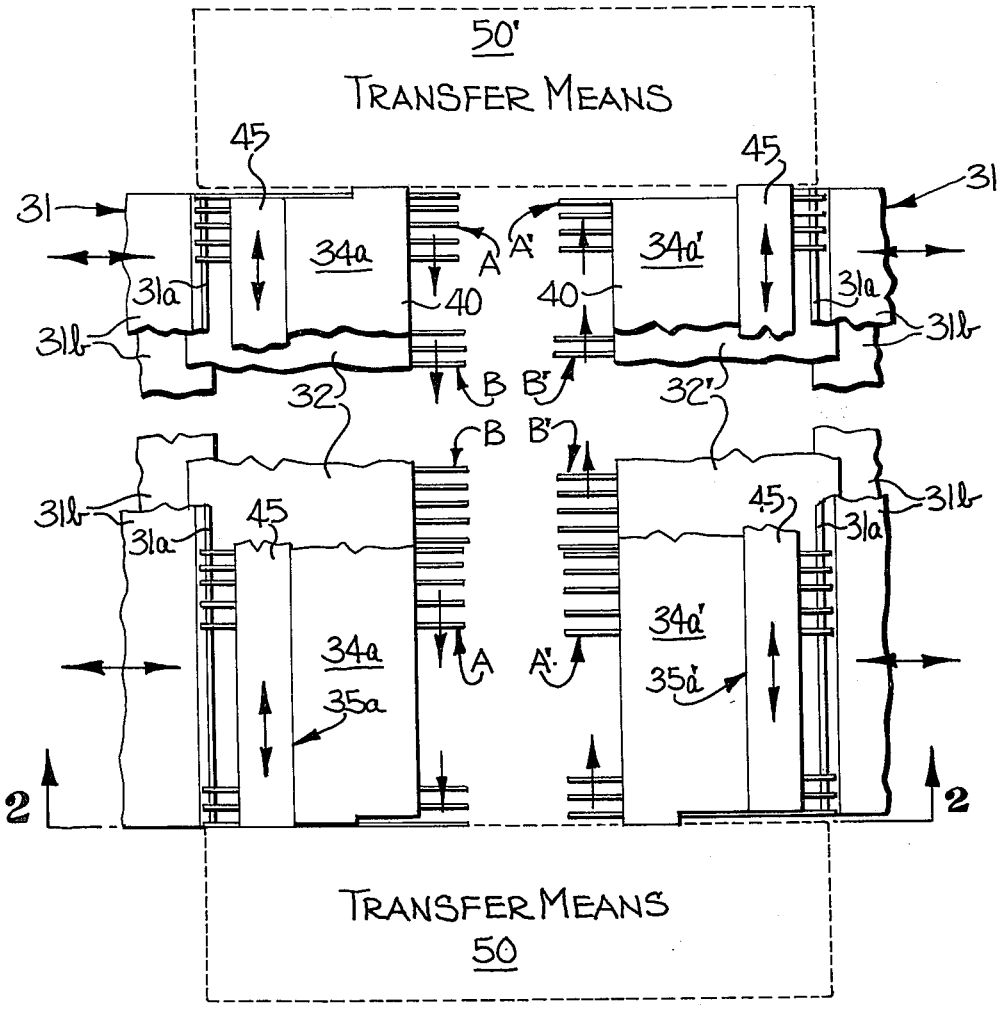

For the purposes of this disclosure, the left-hand weftwise rows of heddles A, B in FIGS. 1 and 2 will be referred to herein as the first rows in the respective first and second sets, and the right-hand weftwise rows of heddles A′, B′ will be referred to herein as the second rows in the respective first and second sets. It will be noted that both of the first rows of heddles A, B are supported adjacent one side of the path of the warp strands S to the fell 16 of the triaxial fabric F being woven, and both of the second rows of heddles A′, B′ are supported adjacent the other side of such path of the warp strands to the fell of the fabric being woven.

As is preferred, in the illustrated embodiment of the invention the weftwise rows of heddles occupy a substantially horizontal position with the heddles being moved horizontally during longitudinal shedding movements thereof. Consequently, a weft inserting means 17 inserts wefts in sheds being formed of the warp strands S in a horizontal plane and on a level substantially below the level of the rows of heddles. Also, the fell 16 of the triaxial fabric F, being woven from the warp strands S and the wefts, extends substantially horizontally and is spaced substantially below the level of the rows of heddles A, A′, B, B′. Thus, the fabric F at the fell 16 thereof moves downwardly in a substantially vertical path during weaving. Suitable beating-up means serves to beat up each successive inserted weft against the fell 16 and operates in timed relation to the operation of the rows of heddles A, A′, B, B′ and the weft inserting means, as is well known. An example of a suitable beating-up means is disclosed in Dow et al U.S. Pat. No. 3,799,209. Accordingly, a further more detailed description of the beating-up means is deemed unnecessary.

Although the rows of heddles, the supporting and controlling mechanisms therefor, and the fell 16 of the fabric F are illustrated as occupying horizontal positions, it is to be understood that they may occupy any desired position, such that the direction of movement of the fabric at the fell 16 during weaving may be in the upward direction or the horizontal direction or in any desired angular direction, without departing from the invention.

Figure 5:
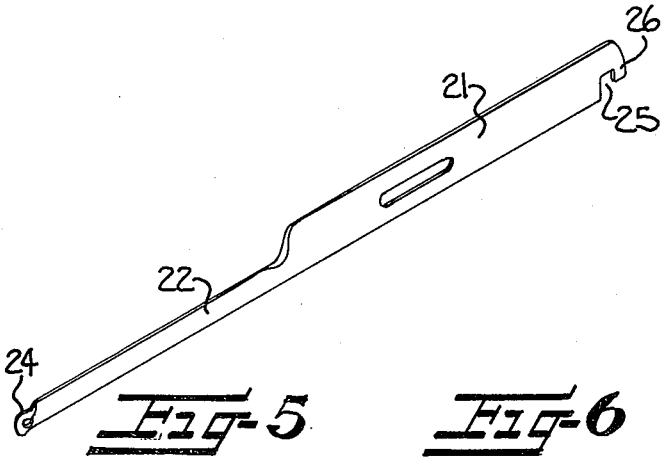
FIG. 5 is a perspective view of a heddle as used in the arrangements of FIGS. 1–4.

Each heddle may be of substantially the type disclosed in copending application Ser. No. 582,246 now U.S. Pat. No. 3,985,160, owned in common with the present invention. Accordingly, it will be observed in FIG. 5 that each heddle is of elongate form and is relatively thin and comprises an elongate body portion 21 of predetermined width, with an elongate narrow, reduced width frontal portion 22 extending forwardly from body portion 21. The reduced width frontal portion 22 may be about one-half as wide as body portion 21 and terminates in a substantially rounded or substantially semicircularly-shaped free end defining the front end of the respective heddle. Each heddle has a strand guide opening or eye 24 therethrough closely adjacent the free front end thereof for guidingly engaging the respective warp strand S. Thus, it will be observed in FIG. 2 that the warp strands S extend through the respective heddles to the fell 16 of the triaxial fabric being woven. The warp strands may be directed to the heddles from a suitable supply source, not shown, remote from the rows of heddles A, A', B, B'.

The heddles in each row A, A', B, B' may be arranged in any desired spaced relationship. It is preferred, however, that the distance between immediately adjacent heddles in each row is at least about equal to the thickness of each heddle so as to accommodate passage of the warp strands S through the heddles of each respective row and between immediately adjacent heddles warpwise of the heddles through which particular warp strands extend. For this reason it also is preferred that the heddles in the first or upper set A, A' are staggered weftwise relative to the heddles in the second or lower set B, B' during each weft insertion. Desirably, the heddles are quite thin and the distance between immediately adjacent heddles in each weftwise row is about the same as the thickness of each heddle so as to permit weaving triaxial fabrics of high density from fine warp strands. Many of the heddles are omitted from each row in FIGS. 1, 3 and 4 for purposes of clarity.

Figure 6:
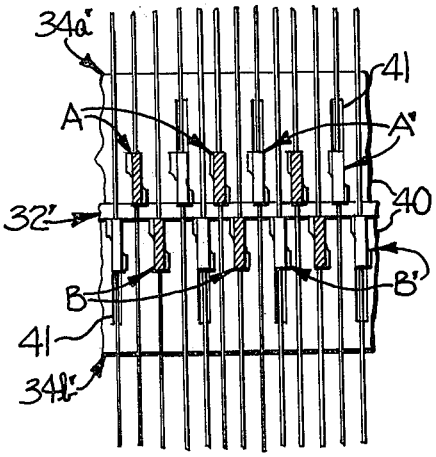
FIG. 6 is an enlarged elevation view, partially in section, taken generally along the line 6—6 in FIG. 2.

In the particular illustrated embodiment, the heddles in the first rows A, B are disposed in offset relation with the respective heddles in the second rows A', B' and the heddles in the first set A, A' are also offset relative to the heddles in the second set B, B' (FIG. 6). Thus whenever any one of the rows of the heddles occupies an extended position, the substantially opposing row in the respective pair may occupy either a retracted position or an extended position. Such an arrangement accommodates production of a variety of forms of triaxial fabrics. Although the illustrated embodiment has the heddles of each row offset with relation to the heddles in other rows, it is to be understood that the heddles in each row may occupy a different position from that described with respect to the heddles in the other rows without departing from this invention.

Referring again to FIG. 5, it is preferred that the opposite longitudinal edges of the heddle extend substantially parallel to each other and, since the elongate frontal portion 22 is of substantially less width than the body portion 21, the body portion defines a projecting shoulder portion on the heddle, which shoulder portion is adapted to be engaged by a shifting bar of a heddle shifting means for shifting each respective row of heddles weftwise during operation of the weaving machine, as will be later explained. Each heddle also is provided with means adapted to be engaged for imparting longitudinal shedding movements thereto. To this end, the rear portion of each heddle, remote from the frontal portion 22 thereof, is provided with a cutout 25 partially defined by a hook-shaped projection 26 on the rear end of the body portion 21 of each heddle.

Figure 3:
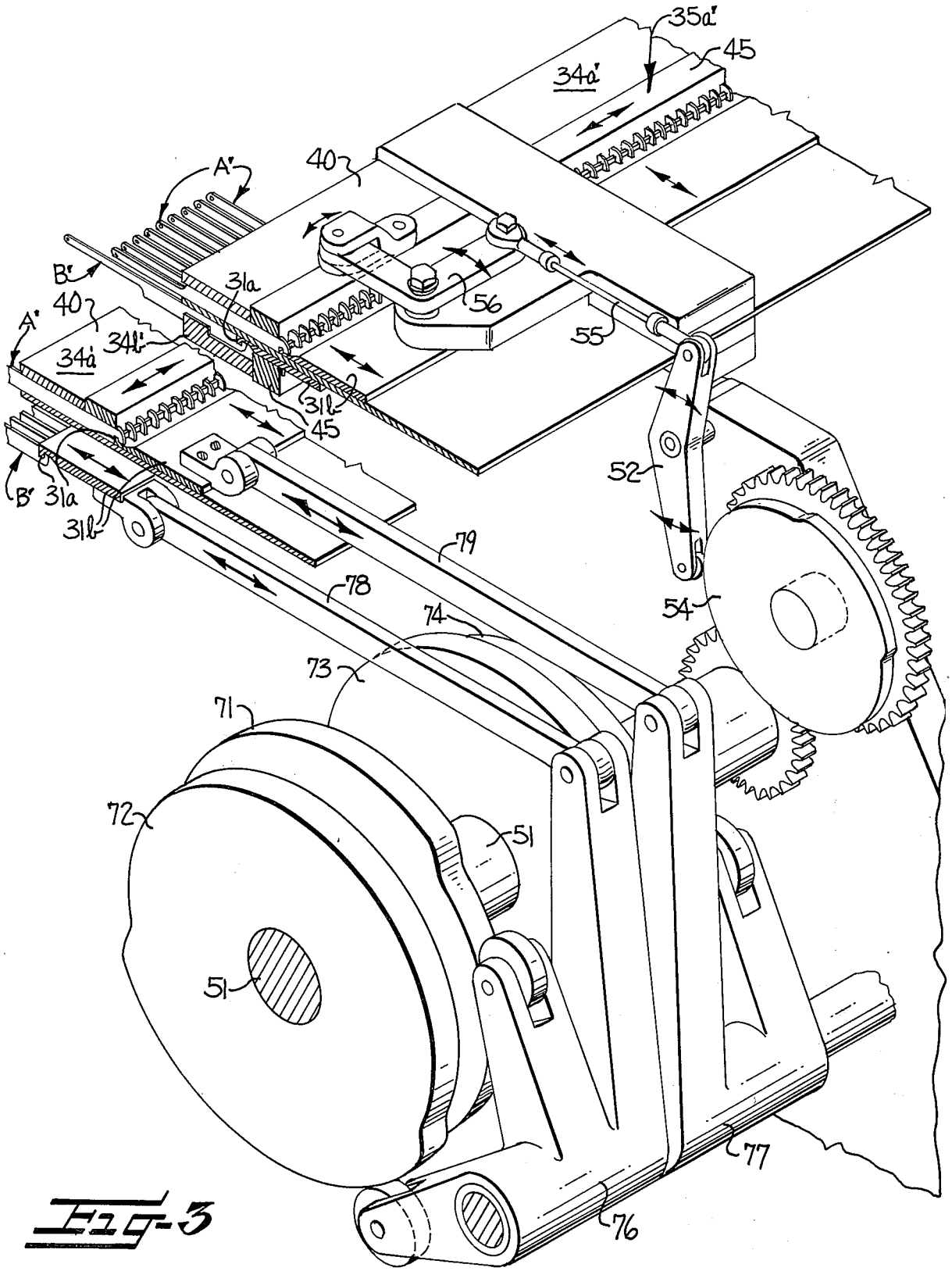
FIG. 3 is an enlarged perspective view, partly broken away, of portions of the weaving machine of FIGS. 1 and 2, particularly illustrating certain drive mechanisms.
Figure 4:
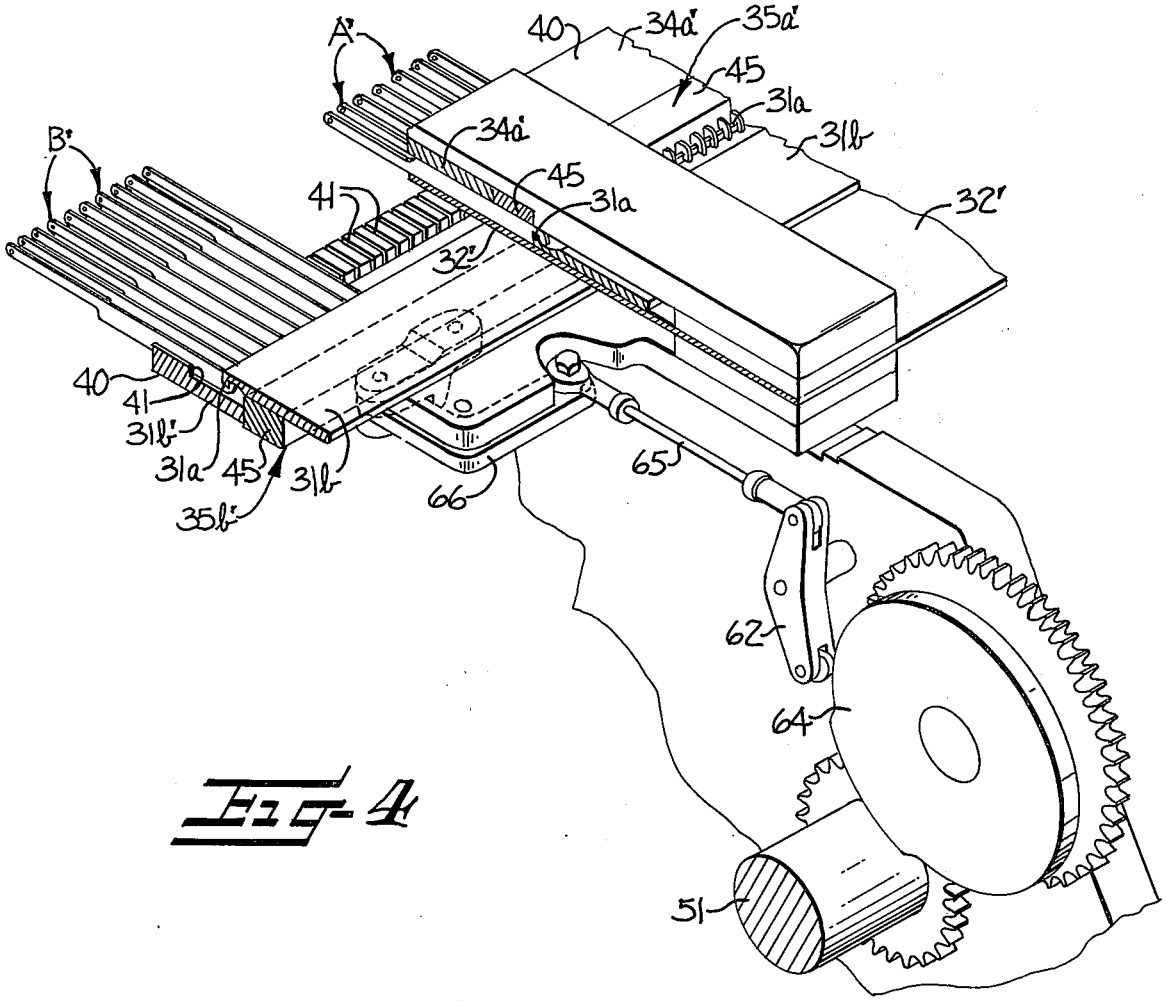
FIG. 4 is a view similar to FIG. 3 illustrating additional drive mechanisms.

As shown in FIGS. 2 through 4, the cutouts 25 in heddles of each row A, A', B, B' are engaged by an elongate rib 31a of a respective shedding means 31, there being one of the shedding means 31 for moving each respective weftwise row of heddles A, A', B, B' longitudinally between the retracted position shown in solid lines in FIG. 2 and the extended position represented by rows A', B shown in broken lines in FIG. 2. In this regard, it will be noted that the proximal longitudinal edges of the heddles in the two first rows A, B may slide against the respective upper and lower surfaces of a first stationary guide plate 32, and the proximal longitudinal edges of the heddles in the second rows A', B' may slide against the respective upper and lower surfaces of a second stationary guide plate 32'. The stationary guide plates 32, 32' may be of a length about equal to the width of the triaxial fabric F and the proximal edges of plates 32, 32' are spaced apart from each other (FIG. 1) to provide an adequate opening for the passage of the warp strands S therethrough and for the formation of the warp sheds thereof with the warp strand guide openings 24 in the heddles A, A', B, B' positioned forwardly beyond the proximal edges of guide plates 32, 32'.

Each warp shedding means 31 may include a weftwise extending heddle shedding bar 31*b*, each of which is movable forwardly and rearwardly according to a predetermined pattern and which has the elongate weftwise extending projection or rib 31a thereon for engaging the cutouts 25 and hook-shaped projections 26 (FIGS. 2 through 4) of the respective rows of heddles A, A', B, B'. It is to be noted that the heddles in rows A, B are being moved from left to right and the heddles in rows A', B' are being moved from right to left in FIG. 2 whenever they are being moved forwardly to extended open shed positions. Also, whenever the heddles are being moved to the retracted open shed positions shown in solid lines in FIG. 2, the heddles are being moved rearwardly.

For the control of the heddles during formation of warp sheds and for shifting the heddles weftwise, means defining passageways are provided for guiding each row of heddles A, B, A', B'. The passageway defining means includes fixed means respectively designated at 34*a*, 34*b*, 34*a*', 34*b*', and movable means respectively designated at 35*a*, 35*b*, 35*a*', 35*b*'.

Each fixed means 34*a*, 34*b*, 34*a*', 34*b*' defines first passageway portions for guidingly receiving heddles upon warp shed forming movement thereof toward one of an extended position and a retracted position and may take the form of an elongate weftwise guide member or bar 40 (FIGS. 1 through 4) suitably supported so that its surface facing toward the corresponding guide plate 32 or 32' is spaced from such guide plate a distance somewhat greater than the width of the reduced width frontal portions 22 (FIG. 5) of the corresponding heddles. The surface of each guide bar 40 adjacent the corresponding stationary guide plate 32, 32' is in the form of a plurality of projecting separators or wall members defining a weftwise row of passageways 41 (FIG. 4) for guiding the respective heddles in movement from and to the aforementioned open shed retracted and extended positions.

The movable means 35*a*, 35*a*', 35*b*, 35*b*' define second passageway portions for guidingly receiving heddles upon shedding movement thereof toward the other of the extended and retracted positions and are provided for moving the respective rows of heddles A, A', B, B′ and warp strands S engaged thereby weftwise during weaving so as to shift each heddle in each row from one passageway to another and thereby move the warp strands from one weftwise location to another so that the warp strands may extend obliquely with respect to the wefts. Accordingly, each movable means comprises an elongate weftwise extending and weftwise movable heddle shifting member or bar 45 positioned rearwardly of and in sliding engagement with, or in close proximity to, the respective heddle guide bar 40. Each heddle shifting bar 45 is provided with a weftwise row of closely spaced forwardly and rearwardly extending separators or wall members to define a weftwise row of passageways (similar to the fixed passageways 41) for guidingly receiving therein the shoulder portions defined by the body portions 21 (FIGS. 2 through 5) on the heddles in the respective row. The surfaces of the heddle shifting bars 45 facing toward the stationary guide plates 32, 32′ are spaced from such guide plates to accommodate the shedding movements of the respective heddle shedding bars 31b in the space between bars 45 and plates 32, 32′.

Suitable control means 47 is shown schematically in the form of a block (FIG. 2) operatively connected to each heddle shifting bar 45 for imparting an active weftwise shifting movement or stroke to each heddle shifting bar 45 following each of, or certain of, the rearward or retracting movements of the respective shedding bars 31*b*. It is to be understood that successive active weftwise strokes of each heddle shifting bar 45 may be effected selectively in either weftwise direction with each such active stroke being effected for a distance substantially equal to an integral multiple of the distance between the centers of adjacent passageways 41. Such weftwise movement of the heddle shifting bars normally aligns the movable second passageway portions with the fixed first passageway portions so that the portions cooperate in guidingly receiving the heddles during their longitudinal movement. As to weftwise movement of heddles, the sum of all of the active weftwise strokes of each heddle shifting bar 45 normally makes the heddles in any given row subject to being transferred away from the same end of such given row to the adjacent end of another of the rows of heddles. Transfer means 50, 50′ for accomplishing such movement has been indicated by blocks in FIG. 1, but forms no major portion of this invention and is subject to separate protection and accordingly is not here described in detail.

In the illustrated embodiment of the present invention it is to be assumed that successive heddles in the two first rows A, B are delivered to the ends of the rows A, B nearest the observer in FIG. 2 and that the successive delivered heddles are transferred by a first transfer means 50 to the adjacent ends of the respective second substantially opposing rows A′, B′. Of course, it is apparent that the successive heddles are delivered to the other leading ends of the latter rows A′, B′ and are transferred to the adjacent trailing ends of the two first rows of heddles A, B by a second transfer means 50′. In any event, it is preferred that the control means 47 for each heddle shifting bar 45 imparts an inactive stroke to the respective heddle shifting bar 45 for returning the same to its original position following each active stroke thereof.

Following each active weftwise stroke of each heddle shifting bar 45, it is to be understood that the respective shedding means 31 moves all the heddles in the respective row forwardly to extended position so as to move the body portions 21 of the corresponding heddles forwardly out of engagement with the passageways in the respective heddle shifting bars 45, thus permitting the heddle shifting bars 45 to return to their original positions in an inactive stroke thereof without then being emcumbered by, or imparting weftwise movement to, the respective heddles.

Suitable drive means for the heddle shifting bars 45 and the shedding means 31 may take the form illustrated in FIGS. 3 and 4, where a main drive shaft 51 has a plurality of control cams mounted thereon for operating corresponding cam follower arms. In driving the heddle shifting bars 45, a cam following crank arm 52 (FIG. 3) engages the surface of a cam 54 driven by a geared connection to the shaft 51. Oscillating movement of the follower arm 52 (indicated by arrows in FIG. 3) drives a connecting rod 55 and pivots a bell crank 56 mounted on a stationary portion of the weaving machine (as again indicated by arrows in FIG. 3). The end of the bell crank 56 remote from connection with the rod 52 is suitably connected with the bar 45 for row A′ of heddles. As illustrated in FIG. 4, a similar arrangement of a follower arm 62, cam 64, connecting rod 65 and bell crank 66 drives the heddle shifting bar 45 for heddle row B′.

Longitudinal movement of the heddles is accomplished by operation of pairs of cams 71, 72, 73, 74 which cooperate with respective follower cranks 76, 77 to reciprocate drive links 78, 79 suitably connected with the shedding bars 31*b*.

In the drawings and specifications, there has been set forth a preferred embodiment of the invention, and although specific terms are employed, they are used in a generic and descriptive sense only and not for purposes of limitation.

That which is claimed is:

1. A weaving machine for making triaxial fabrics comprising a plurality of elongate heddles for guiding warp strands, means for longitudinally moving said heddles for forming the warp strands guided thereby into warp sheds, means for inserting wefts through warp sheds formed by longitudinal movement of said heddles, means defining passageways for guiding said heddles during longitudinal movement, and means for moving said heddles and the warp strands guided thereby weftwise during weaving to shift heddles from one passageway to another and to move the warp strands from one weftwise location to another.

2. A weaving machine according to claim 1 wherein said passageway means comprises a plurality of separator means spaced weftwise for guidingly receiving heddles therebetween and further wherein each of said heddles has a warp strand guide opening therethrough adjacent one end thereof for threadingly receiving a corresponding warp strand and has shoulder means for guidingly engaging said separator means and adapted to be engaged for shifting said heddle weftwise.

3. A weaving machine according to claim 2 wherein said separator means cooperate with said heddles for arrangin g said heddles in at least two substantially opposing rows.

4. A weaving machine according to claim 2 wherein said separator means cooperate with said heddles for arranging said heddles in at least two rows spaced warpwise one from the other.

5. A weaving machine according to claim 1 wherein said passageway defining means comprises fixed means for defining first passageway portions and movable means for defining second passageway portions normally aligned with said first passageway portions, said first and second passageway portions cooperating for guidingly receiving said heddles during warp shed forming movement thereof and further wherein said means for moving said heddles weftwise is operatively connected with said movable passageway defining means for moving said second passageway portions relative to said first passageway portions.

6. A weaving machine according to claim 5 wherein each of said fixed passageways defining means and said movable passageway defining means comprises a plurality of separators spaced weftwise one from another for guidingly receiving individual ones of said heddles between cooperating weftwise pairs thereof, and each of said heddles has shoulder means for guidingly engaging said weftwise pairs of separators.

7. A weaving machine for making triaxial fabrics comprising a plurality of elongate heddles for guiding warp strands and each having means thereon adapted to be engaged for weftwise shifting thereof, means for longitudinally moving said heddles to and from extended and retracted positions for forming the warp strands guided thereby into warp sheds, means for inserting wefts through warp sheds formed by longitudinal movement of said heddles, means defining passageways for arranging said heddles in weftwise rows and for guiding said heddles in longitudinal movement and including fixed means defining first passageway portions for guidingly receiving said engagable means upon longitudinal movement of said heddles toward one of the extended and retracted positions and movable means defining second passageway portions for guidingly receiving said engagable means upon longitudinal movement of said heddles toward the other of the extended and retracted positions, and means operatively connected with said movable passageway defining means for moving said second passageway portions weftwise relative to said first passageway portions and thereby for moving said heddles and the warp strands guided thereby weftwise during weaving to shift heddles from one passageway to another and to move the warp strands from one weftwise location to another.

8. A weaving machine according to claim 7 wherein said first passageway portions cooperate with said heddles for arranging said heddles in at least two substantially opposing rows with the heddles in one row offset weftwise from the heddles in another opposing row for facilitating avoidance of abutting collision of heddles as the same move longitudinally between extended and retracted positions.

9. A weaving machine according to claim 7 wherein said first passageway portions cooperate with said heddles for arranging said heddles in at least two rows spaced warpwise one from the other with the heddles in one row offset weftwise from the heddles in another warpwise spaced row for facilitating avoidance of entanglement of warp strands guided by heddles as the same move longitudinally between extended and retracted positions.

10. A weaving machine according to claim 7 wherein said movable means defining second passageway portions receives said heddles for weftwise shifting thereof upon said heddles being longitudinally moved to the retracted position.

11. A weaving machine according to claim 7 wherein said passageway defining means comprises a plurality of separators spaced weftwise one from another for guidingly receiving heddles between cooperating weftwise pairs thereof, said separators having a predetermined substantially uniform weftwise thickness dimension and being spaced apart a predetermined substantially uniform weftwise distance for establishing a gauge for triaxial fabric made on the weaving machine.

12. A weaving machine for making triaxial fabrics comprising a plurality of elongate heddles for guiding warp strands and each having shoulder means thereon adapted to be engaged for weftwise shifting thereof, means for longitudinally moving said heddles for forming the warp strands guided thereby into warp sheds, means for inserting wefts through warp sheds formed by longitudinal movement of said heddles, means defining passageways for arranging said heddles in at least two substantially opposing weftwise rows and for guiding said heddles during longitudinal movement thereof and including a plurality of fixed separators defining first passageway portions and a plurality of movable separators defining second passageway portions normally aligned with said first passageway portions, said first and second passageway portions cooperating for guidingly receiving said shoulder means upon longitudinal movement of said heddles, and means operatively connected with said movable separators for moving said second passageway portions defined thereby weftwise relative to said first passageway portions and thereby moving said heddles and the warp strands guided thereby weftwise during weaving to shift heddles from one passageway to another and to move the warp strands from one weftwise location to another.

13. A weaving machine according to claim 12 wherein said separators are spaced weftwise one from another for guidingly receiving individual ones of said heddles between cooperating weftwise pairs of said separators.

14. A weaving machine for making triaxial fabrics comprising a plurality of elongate heddles for guiding warp strands and each having means thereon adapted to be engaged for weftwise shifting thereof, means for longitudinally moving said heddles for forming the warp strands guided thereby into warp sheds, means for inserting wefts through warp sheds formed by longitudinal movement of said heddles, means defining passageways for guiding said heddles during longitudinal movement thereof and arranging said heddles in a plurality of pairs of substantially opposing weftwise rows with the pairs of rows spaced warpwise from each other, said passageway defining means including for each weftwise row a plurality of fixed separators and a plurality of movable separators, said fixed separators defining between cooperating weftwise pairs thereof first passageway portions for guidingly receiving said engagable means upon longitudinal movement of said heddles, said movable separators defining between cooperating weftwise pairs thereof second passageway portions normally aligned with said first passageway portions and cooperating therewith for guidingly receiving said engagable means upon longitudinal movement of said heddles, and means operatively connected with said movable separators for moving said second passageway portions defined thereby weftwise relative to said first passageway portions and thereby moving said heddles and the warp strands guided thereby weftwise during weaving to shift heddles from one passageway to another and to move the warp strands from one weftwise location to another.

15. A weaving machine according to claim 14 wherein said heddles have a predetermined substantially uniform weftwise thickness dimension at said engagable means and said separators have a predetermined substantially uniform weftwise thickness dimension and are spaced apart a predetermined substantially uniform weftwise distance for establishing a gauge for triaxial fabric made on the weaving machine.

16. A weaving machine for making triaxial fabrics comprising a plurality of elongate heddles for guiding warp strands and each having means thereon adapted to be engaged for weftwise shifting thereof, a plurality of separator means spaced weftwise one from another and defining passageways for arranging said heddles in weftwise rows and for guidingly receiving individual ones of said heddles between cooperating weftwise pairs thereof while guiding said heddles in longitudinal movement, said separator means including rows of fixed separators defining first passageway portions for guidingly receiving said engagable means upon longitudinal movement of said heddles toward one of an extended position and a retracted position and rows of movable separators defining second passageway portions for guidingly receiving said engagable means upon longitudinal movement of said heddles toward the other of the extended and retracted positions, means for longitudinally moving said heddles to and from said extended and retracted positions for forming the warp strands guided thereby into warp sheds, means for inserting wefts through warp sheds formed by longitudinal movement of said heddles, and means operatively connected with said rows of movable separators for moving said second passageway portions defined thereby weftwise relative to said first passageway portions and thereby moving said heddles and the warp strands guided thereby weftwise during weaving to shift heddles from one passageway to another and to move the warp strands from one weftwise location to another.

17. A weaving machine for making triaxial fabrics comprising a plurality of elongate heddles for guiding warp strands and each having means thereon adapted to be engaged for weftwise shifting thereof, means defining passageways for arranging said heddles in weftwise rows and for guiding said heddles in longitudinal movement and including fixed means defining first passageway portions for guidingly receiving said engagable means upon longitudinal movement of said heddles toward an extended position and movable means defining second passageway portions for guidingly receiving said engagable means upon longitudinal movement of said heddles toward a retracted position, means for longitudinally moving said heddles to and from said extended and retracted positions for forming the warp strands guided thereby into warp sheds, means for inserting wefts through warp sheds formed by longitudinal movement of said heddles, and means operatively connected with said movable passageway defining means for moving said second passageway portions weftwise relative to said first passageway portions in timed relation to longitudinal movement of said heddles and thereby for moving said heddles and the warp strands guided thereby weftwise while said heddles are in retracted position to shift heddles from one passageway to another and to move the warp strands from one weftwise location to another.

18. In a method of weaving triaxial fabrics wherein a plurality of warp strands are guidingly engaged by elongate heddles arranged in weftwise rows and formed into warp sheds by longitudinal movement of the heddles, the improvement comprising guiding the heddles in passageways during longitudinal movement of the heddles, and shifting the heddles weftwise during weaving from one passageway to another to move the warp strands engaged thereby weftwise from one location to another.

19. A method according to claim 18 wherein the guiding of heddles in passageways comprises guiding each heddle in a corresponding individual passageway and further wherein the shifting of heddles weftwise comprises shifting heddles from one passageway to an immediately adjacent passageway.

20. A method according to claim 18 wherein the heddles are arranged in substantially opposing rows and further wherein the shifting of heddles comprises shifting heddles in opposing rows in opposite weftwise directions.

21. A method according to claim 18 wherein the heddles are arranged in substantially opposing rows and further wherein the guiding of heddles in passageways comprises guiding heddles of opposing rows in weftwise offset relation.

22. In a method of weaving triaxial fabric wherein a plurality of warp strands are threadingly engaged in eyes adjacent the ends of elongate heddles arranged in weftwise rows and formed into warp sheds by longitudinal movement of the heddles, the improvement comprising guiding the heddles in passageways during longitudinal movement of the heddles from and to extended and retracted positions, and shifting the heddles weftwise from one passageway to another while in retracted positions to move the warp strands engaged thereby weftwise from one location to another.

* * * * *